US006470524B1

(12) United States Patent
Mairantz

(10) Patent No.: US 6,470,524 B1
(45) Date of Patent: Oct. 29, 2002

(54) COMPOSITE BRIDGE SUPERSTRUCTURE WITH PRECAST DECK ELEMENTS

(76) Inventor: Benjamin Mairantz, 8 Hertzl Street, Ramat-Gan 52431 (IL)

( * ) Notice: Subject to any disclaimer, the term of this patent is extended or adjusted under 35 U.S.C. 154(b) by 0 days.

(21) Appl. No.: 09/257,001

(22) Filed: Feb. 25, 1999

(30) Foreign Application Priority Data

Mar. 4, 1998 (IL) ..... 123543

(51) Int. Cl.[7] ..... E01D 21/00
(52) U.S. Cl. ..... 14/77.1; 14/74.5
(58) Field of Search ..... 14/1, 73, 74.5, 14/77.1, 78

(56) References Cited

U.S. PATENT DOCUMENTS

| | | | | |
|---|---|---|---|---|
| 2,375,744 A | | 5/1945 | Abeles | |
| 3,354,594 A | | 11/1967 | Kilcher | |
| 3,706,125 A | | 12/1972 | Hopkins | |
| 3,910,545 A | * | 10/1975 | Langford | 249/7 |
| 3,952,468 A | * | 4/1976 | Soum | 52/227 |
| 4,123,485 A | | 10/1978 | Tang | |
| 4,509,305 A | | 4/1985 | Guinard | |
| 4,610,117 A | | 9/1986 | Schambeck | |
| 4,660,243 A | | 4/1987 | Kinkel | |
| 4,710,994 A | * | 12/1987 | Kishida et al. | 14/1 |
| 4,972,537 A | * | 11/1990 | Slaw, Sr. | 14/1 |
| 5,025,522 A | | 6/1991 | Eskew | |
| 5,134,741 A | | 8/1992 | Carcassi | |

(List continued on next page.)

FOREIGN PATENT DOCUMENTS

WO WO 98/03737 12/1998

*Primary Examiner*—Thomas B. Will
*Assistant Examiner*—Raymond W Addie

(74) *Attorney, Agent, or Firm*—Edward Langer, Pat. Atty.

(57) ABSTRACT

A method for constructing a composite bridge superstructure of simple precast elements. According to the method, the bridge superstucture is comprised of one or more prestressed beams aligned substantially parallel to the bridge longitudinal axis. On top of the prestressed beams, there is placed a plurality of full width, precast deck slabs forming the bridge deck, with the precast deck slabs being transversely disposed side by side, with adjacent slabs attached by joints to complete the bridge deck structure. The deck slabs are spaced from the beams by spacing devices, such that a gap is left between the beams and the deck slabs and the bridge deck structure is prestressed separately from the beams. Subsequent to the prestressing of the deck structure and the beams, the bridge deck structure is connected to the beams by a concrete layer cast in situ in the gap between the bottom face of the precast deck slabs and the top face of the prestressed beams. The concrete is preferably of the low shrinkage type but normal shrinkage concrete may also be employed. The connection is further reinforced by a plurality of shear stirrups. The method is characterized by separate prestressing of the deck structure and the beams and by natural compression of the connecting concrete layer resulting in significant savings of construction time and costs. The construction sequence according to the method enables the deck structure as well as the cast in place concrete layer connecting the deck structure to the beams to undergo a natural compressing process due to time dependent creep and shrinkage contraction of the beams relative to the connecting layer and the deck structure, thereby eliminating the need to apply additional prestressing. In addition, the substantially separate longitudinal prestressing of the deck structure and the beams is highly effective, achieving considerable saving of prestressing steel. The natural compressing of the deck structure and the cast-in-place concrete layer result in crack-free condition and better riding quality of the deck, thereby eliminating the well known drawbacks of additional prestressing, and saving maintenance costs.

15 Claims, 6 Drawing Sheets

U.S. PATENT DOCUMENTS 5,144,710 A 9/1992 Grossman
5,301,483 A 4/1994 Grossman
5,305,575 A 4/1994 Grossman
5,425,152 A * 6/1995 Teron ..... 14/24
5,454,128 A * 10/1995 Kwon ..... 14/73
5,457,839 A * 10/1995 Csagoly ..... 14/73
5,553,439 A 9/1996 Grossman
5,655,243 A * 8/1997 Kim ..... 14/73
5,802,652 A 9/1998 Smith
5,850,653 A * 12/1998 Mufti ..... 14/73
5,867,855 A * 2/1999 Kim ..... 14/77.1
5,978,997 A * 11/1999 Grossman ..... 14/73
6,018,834 A * 2/2000 Svensson ..... 14/74.5

* cited by examiner

COMPOSITE BRIDGE SUPERSTRUCTURE WITH PRECAST DECK ELEMENTS

FIELD OF THE INVENTION

The present invention relates to a method for erection of an elevated prestressed composite bridge superstructure with precast concrete deck elements.

BACKGROUND OF THE INVENTION

One method presently used for the construction of elevated long span concrete bridges involves the use of cast-in-place cantilever segmental construction, wherein the spans are cast segmentally using forms supported by the partly completed construction. According to this method, construction proceeds in opposite directions on each side of an intermediate pier by the balanced cantilever method wherein new segments are post tensioned to the previously completed structure, a closing joint is created and finally the joint structure is further post tensioned to achieve fill continuity.

The above method has also been adapted to the use of precast segments instead of cast-in-place segments, wherein individual segments are lifted into position and connected to the already completed work by post-tensioning.

Another method, known as incrementally launched bridge construction, involves in situ construction of a bridge in relatively long segments. According to this method, casting forms are situated at a fixed position behind the end of the bridge and after the segment is set and prestressed the already completed part of the bridge is launched forward on temporary sliding bearings leaving the forms free for casting the next segment. The process is repeated until the entire bridge is completed.

The main drawback of all the above described methods is the excessive need for post-tensioning which is repeated at several stages to accomodate temporary conditions during construction.

Another drawback of the existing methods is the excessive use of prestressing steel resulting from the need to prestress the entire cross section including parts under permanent compression.

The precast segmental construction process is characterized by further drawbacks. Expensive forms, specially designed for casting the segments whether in situ or in the precasting yard are necessary to this method. Other requirements include the need for temporary fixing of the bridge deck to the pier structure during the unbalanced stage of the cantilevers and the need to strengthen the pier against the unbalanced moment.

A further method for constructing a prefabricated bridge deck teaches a composite structure comprised of precast concrete deck slabs laid side by side and attached on top of steel girders. The transversely oriented slabs may be post tensioned in the direction of traffic to improve longitudinal behaviour. In this latter method, composite action between deck slabs and steel girders is established in the last stage of construction, subsequent to the completion of post-tensioning, wherein the composite action is developed by shear connectors pre-attached to the top flange of the girder. It is also characteristic of this method that a series of block-outs, aligned with the shear connectors, are left in the precast slabs, to be filled with mortar after completion of the deck.

Once again in this method the main drawback is the considerable prestressing loss due to shrinkage and creep that severely reduce the effectiveness of the longitudinal prestressing of the deck.

Another drawback of this method is the need to delay the establishment of composite action in order to allow for a certain amount of free creep and shrinkage deformation of the slabs, resulting in a substantial delay of construction.

OBJECTS OF THE INVENTION

It is the primary object of the present invention to provide an efficient and cost effective method for the construction of an elevated prestressed composite concrete bridge with a deck structure that is made of simple precast elements while eliminating the drawbacks of the prior art.

It is another object of the present invention to enable the prestressing of the said deck structure and the longitudinal beams supporting the said deck structure while still unconnected, thereby creating considerable saving in prestressing steel and simplifying the prestressing process.

It is yet another object of the present invention to suggest a composite bridge structure that uses simple precast deck elements and uncomplicated procedures thereby reducing the time and costs of construction.

SUMMARY OF THE INVENTION

The present invention relates to a novel method for the construction of an elevated prestressed composite bridge.

The invention proposes a method for constructing a composite bridge superstructure assembled from one or more longitudinally prestressed composite members, each composite member comprising one or more concrete beams bridging a span and a deck structure made of a plurality of precast concrete slabs transversely disposed above the said concrete beams, with a layer of concrete connecting the deck structure to the beams, and shear stirrup means for transferring shear force between the deck structure and the beams.

The inventive method is characterized by separate prestressing of the deck structure and the beams and by natural compression of the connecting concrete layer, resulting in significant savings of construction time and costs.

According to the inventive method, the bridge superstucture is comprised of one or more prestressed beams aligned substantially parallel to the bridge longitudinal axis. On top of the prestressed beams, there is placed a plurality of full width, precast deck slabs forming the bridge deck, with the precast deck slabs being transversely disposed side by side, with adjacent slabs attached by joints to complete the bridge deck structure. The deck slabs are spaced from the beams by spacing means, such that a gap is left between the beams and the deck slabs and the bridge deck structure is prestressed separately from the beams.

The bridge deck structure is connected to the beams by a concrete layer cast in situ in the gap between the bottom face of the precast deck slabs and the top face of the prestressed beams subsequent to the prestressing of the deck structure and the beams. The concrete is preferably of the low shrinkage type but normal shrinkage concrete may also be employed. The connection is further reinforced by a plurality of shear stirrup means.

In accordance with the invention the deck structure is prestressed separately from the beams in any desired sequence as required by design considerations, while the already prestressed beams may be treated by additional post-tensioning at this stage, separately from the deck structure. Only then is the deck structure attached to the beams by the cast-in-place concrete and shear reinforcement thereby creating a composite member. Several such composite members may be transversely connected to form a wider deck.

The construction sequence according to the inventive method enables the deck structure as well as the cast-in-place concrete layer connecting the deck structure to the beams to undergo a natural compressing process due to time dependent creep and shrinkage contraction of the beams relative to the connecting layer and the deck structure, thereby eliminating the need to apply additional prestressing.

It is an additional advantage of the invention that since the substantially separate longitudinal prestressing of the deck structure and the beams is highly effective, considerable saving of prestressing steel is achieved.

In accordance with a further advantage of the invention, the natural compressing of the deck structure and the cast-in-place concrete layer result in crack-free condition and better riding quality of the deck, thereby eliminating the well known drawbacks of additional post-tensioning required to maintain compression over the joints, and saving maintenance costs.

In accordance with yet another advantage of the inventive method, the proposed separation between deck structure and beam construction enables simplification of the formworks which in turn results in substantial saving of costs. It is an additional advantage that the bridge deck structure is substantially comprised of simple precast elements whereby pouring of the deck as a whole or in parts in situ is avoided.

Additional features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF A PREFERRED EMBODIMENT

Details of the invention shall now be described in accordance with a preferred embodiment and with reference to the drawings. In the preferred embodiment the bridge superstructure consists of a single composite member with a pair of prestressed beams.

Figure 1:
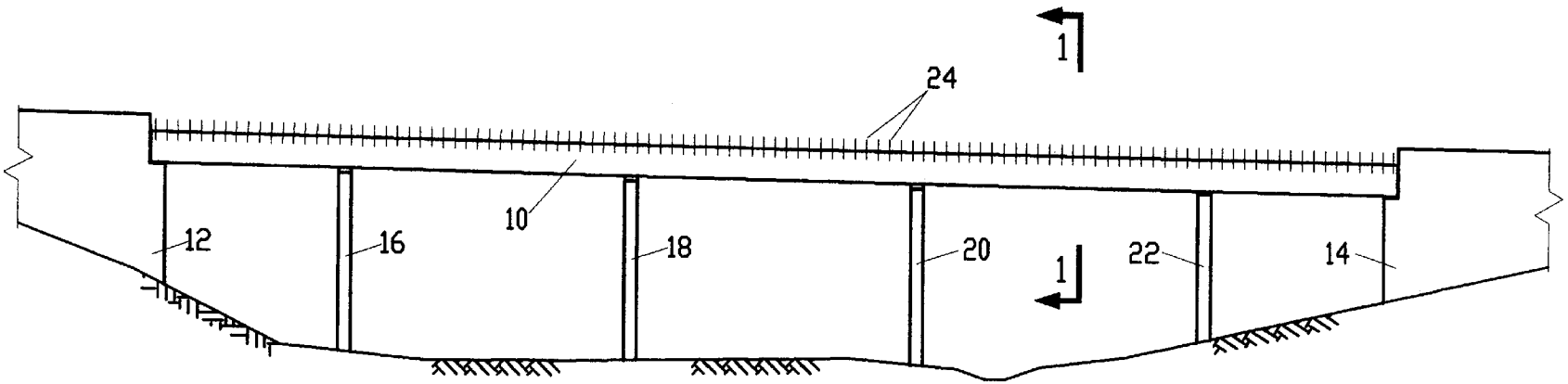
FIGS. 1–3 show various stages of the construction of a bridge in accordance with a preferred embodiment of the present invention.

As shown in FIG. 1, construction of the composite member begins by erecting a pair of prestressed beams 10 (of which only the proximally disposed beam is shown) spanning the gap between abutments 12 and 14. A plurality of pre-erected piers 16, 18, 20 and 22 are used to support the prestressed beams 10 as known in the art. A plurality of shear stirrup means 24 are disposed along each of the prestressed beams 10 respectively.

Figure 4:
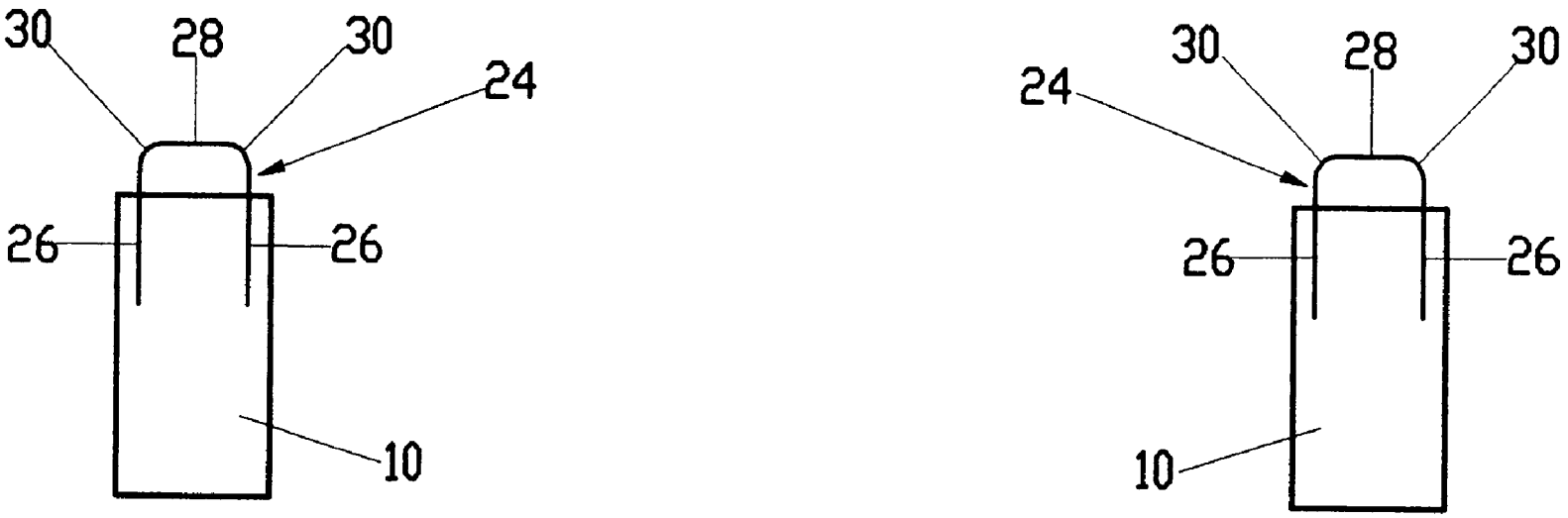
FIG. 4 is a cross-sectional view taken along section lines 1—1 of FIG. 1.

As seen best in the cross-sectional view of FIG. 4 taken along section lines 1—1 of FIG. 1, each of the shear stirrup means 24 is substantially U-shaped, with a pair of legs 26 embedded in one of the prestressed beams 10 and a loop 28 having paired bends 30 horizontally spaced from each other, projecting above the pre stressed beam 10.

It will be understood that the shear stirrup means for the inventive method may be made in accordance with various designs that are different from the one described and shown herein and they may be arranged within the longitudinally prestressed beams 10 in accordance with diverse layouts. It will be further understood that the juxtaposition of the pairs of shear stirrup means as shown in FIG. 4 need not be observed.

Figure 2:
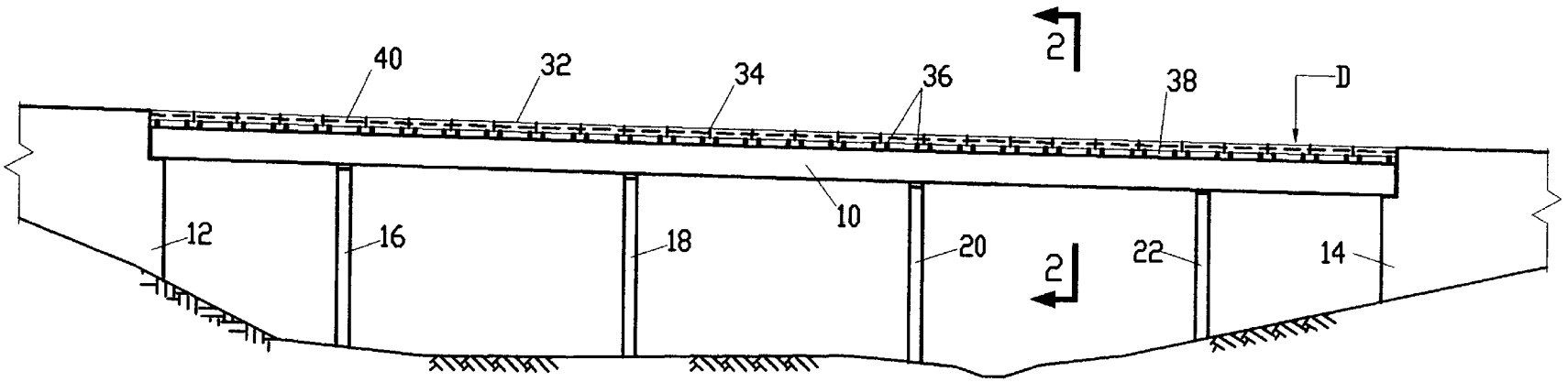

The second stage of construction is shown in FIG.2. At this stage, a plurality of full width precast concrete slabs 32 are transversely disposed on top of the prestressed beams 10 in any sequence as required and adjacent slabs are connected by respective joints 34 to form a continuous deck structure D. The precast concrete slabs 32 are upwardly spaced from the prestressed beams 10 by a plurality of temporary supports 36 such that a gap 38 remains between the prestressed beams 10 and the deck structure D.

The deck structure D is then prestressed by a plurality of prestressing means 40 in accordance with design requirements as known in the art, and in a direction that is substantially parallel to prestressed beams 10.

In accordance with a preferred embodiment, the joints 34 between the adjacent deck slabs 32 may be match cast joints wherein the adjacent slabs are attached by means of an adhesive such as an epoxy glue.

In accordance with another preferred embodiment the precast slabs 32 are joined by cast in situ concrete joints.

It will be appreciated that the number of precast desk slabs 32 may vary. Similarly, the sequence of laying out the precast slabs 32 on top of the prestressed beams 10 as well as the prestressing sequence of the deck structure D or any parts of the deck structure D may vary. It will be further understood that the prestressed beams 10 may be subjected to further post-tensioning at any point of time before, during or after the prestressing of the deck structure D, as determined by design considerations.

Figure 5:
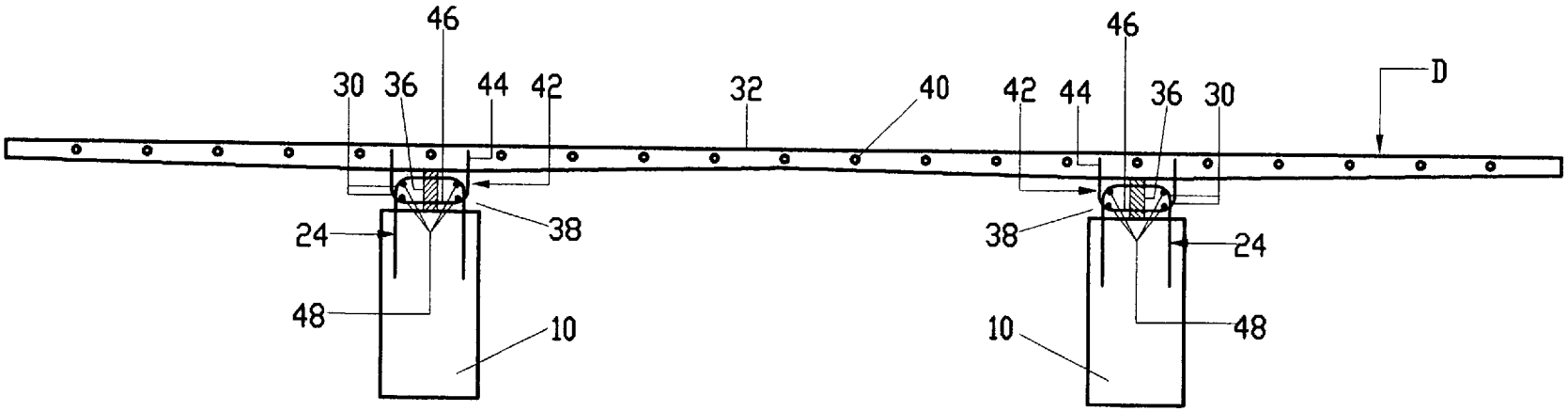
FIG. 5 is a cross-sectional view taken along section lines 2—2 of FIG. 2.

As seen best in the cross-sectional view of FIG. 5 taken along section lines 2—2 of FIG. 2, the separate prestressing of the deck structure D and the longitudinally prestressed beams 10 is enabled by the temporary supports 36 spacing the deck structure D from the beams 10 and creating a gap 38 that separates the beams 10 from the deck structure D. FIG. 5 also shows the prestressing means 40 employed for prestressing the deck structure D separately from the beams 10 in accordance with the inventive method.

Referring again to FIG. 5, a plurality of shear stirrup means 42 are embedded in the precast slabs 32, downwardly projecting from the precast slabs 32 and overlapping the upwardly projecting stirrup means 24 embedded within the prestressed beams 10. Each of the downwardly projecting stirrup means 42 is made with a pair of legs 44 embedded in one of the precast slabs 32 and with a loop 46 having a pair of horizontally spaced bends 30, projecting below the precast deck slab 32.

It will be understood that more than one shear stirrup means 42 may be embedded in each of the precast deck slabs 32. It will be further appreciated that the shear stirrup means 42 may be made in accordance with diverse designs other than described and shown herein.

As shown in FIG. 5, within stirrup means 24, 42 there are disposed longitudinally extending reinforcing bars 48, inwardly removed from each of the bends 30 respectively and temporary supports 36, situated within the bends 30.

Figure 3:
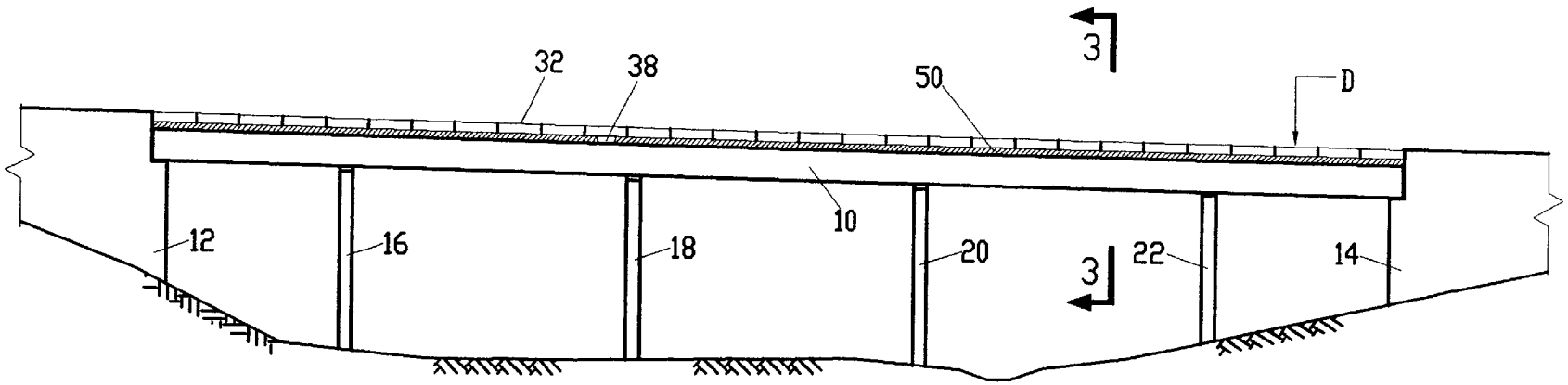

FIG. 3 shows the third stage of construction wherein the gap 38 defined as a cavity between deck structure D and prestressed beams 10 is closed by formwork and is filled to form a concrete layer 50 with concrete, cast in situ to form a concrete layer 50. Thus, a composite section, comprising precast beams 10, deck structure D and concrete layer 50 is accomplished, without the need for further post-tensioning.

According to another preferred embodiment of the invention, the entire composite section, including prestressed beams 10, deck structure D and cast in situ concrete layer 50 is subjected to further post-tensioning following the hardening of the concrete layer 50.

In the preferred embodiment the concrete layer 50 is made of low shrinkage concrete. However it is envisaged that normal shrinkage concrete may be used in the inventive composite bridge structure.

Figure 6:
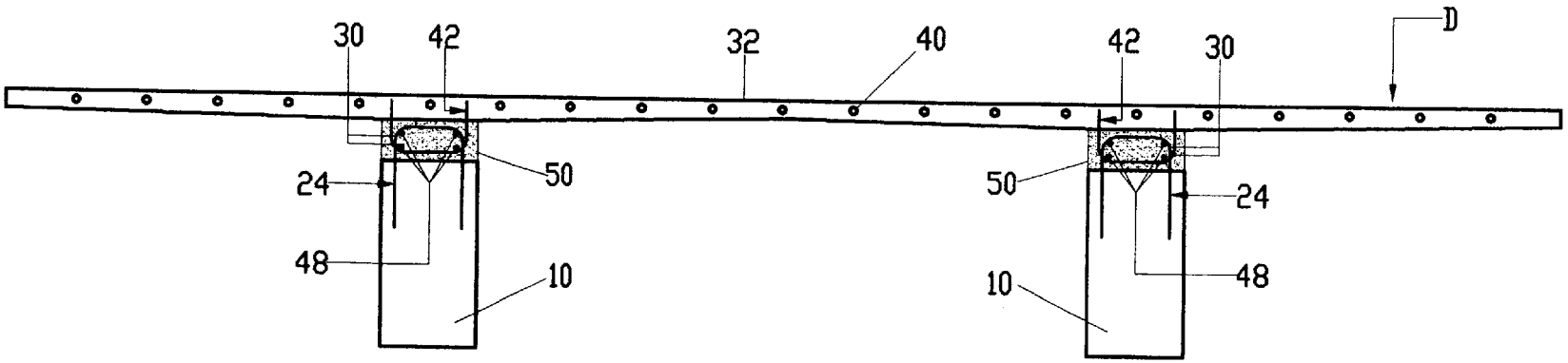
FIG. 6 is a cross-sectional view taken along section lines 3—3 of FIG. 3

As seen in the cross-sectional view of FIG. 6 taken along section lines of FIG. 3, the gap 38 between the prestressed beams 10 and the deck structure D is completely filled by a concrete layer 50 and the stirrup means 24 and 42 as well as the longitudinal reinforcing bars 48 are embedded in the concrete layer 50 such that transfer of shear forces between the deck structure D and the prestressed beams 10 is enabled via the concrete layer 50.

It will be appreciated that the shape, size and number of the shear stirrup means 24 and 42 as well as the number and outlay of the longitudinal reinforcing bars 48 may vary and will be determined by design considerations.

It will be further appreciated that any number of prestressed beams may be used and they may be made in any suitable shape according to design considerations.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

I claim:

1. A method for constructing a composite bridge structure comprising the following steps:

erecting at least one prestressed beam of substantially uniform profile provided with upwardly projecting shear stirrups to span a distance between abutments;

transversely disposing a plurality of precast concrete slabs of substantially uniform profile provided with downwardly projecting shear stirrups on top of said prestressed beam such that overlapping occurs between said upwardly projecting and downwardly projecting shear stirrups for transfer of shear forces between said prestressed beams and said precast concrete slabs, wherein said precast concrete slabs remain upwardly spaced at a desired distance from said prestressed beam by a plurality of temporary support means such that a gap defining a cavity is created, horizontally extending between said prestressed beam and said precast concrete slabs;

connecting adjacent pairs of said precast concrete slabs by respective joints to form a continuous deck structure;

prestressing said upwardly spaced continuous deck structure independently of said prestressed beam, in a direction that is substantially parallel to said prestressed beam, said independent prestressing being enabled by said plurality of temporary support means;

closing said cavity with framework; and casting in situ within an entire volume of said cavity a continuous concrete layer between said independently prestressed deck structure and said prestressed beam to form a composite section, such that transfer of said shear transfer forces is enabled between said deck structure and said prestressed beam via said concrete layer, said composite section comprising said at least one prestressed beam, said continuous deck structure, said shear stirrups and said concrete layer.

2. The method of claim 1 wherein a plurality of prestressed beams is erected.

3. The method of claim 1 further comprising the additional step of subjecting said prestressed beam separated by said gap from said upwardly spaced deck structure to further stressing as necessary.

4. The method of claim 3 wherein said additional post-tensioning step is performed simultaneously with said prestressing of the deck structure.

5. The method of claim 3 wherein said additional post-tensioning step is performed before said prestessing of the deck structure.

6. The method of claim 3 wherein said additional post-tensioning step is performed subsequent to said prestressing of the deck structure.

7. The method of claim 2 wherein said prestressed beams are supported on a plurality of piers erected between abutments.

8. The method of claim 1 wherein said shear stirrups for transfer of shear forces between said prestressed beam and said precast concrete gap, via said concrete layer, are made of metal.

9. The method of claim 1 wherein said joints between said adjacent slabs are match cast joints attached by means of an adhesive.

10. The method of claim 1 wherein said joints between said adjacent slabs are made of concrete cast in situ.

11. The method of claim 1 wherein parts of said deck structure separated by said temporary support, are separately prestressed in any sequence as required.

12. The method of claim 1 further comprising longitudinally extending reinforcing bars provided within said concrete layer cast within said cavity.

13. The method of claim 1 further comprising the step of further post-tensioning said composite section of the entire composite structure including said prestressed beams, said deck structure and said concrete layer within said cavity.

14. A composite bridge superstructure comprising:

a plurality of prestressed beams of substantially uniform profile provided with upwardly projecting shear stirrups spanning a distance between abutments and a plurality of precast concrete slabs of substantially uniform profile provided with downwardly projecting shear stirrups transversely disposed on top of said prestressed beams wherein said upwardly projecting and downwardly projecting stirrups are arranged in overlapping formation, wherein said precast concrete slabs remain upwardly spaced at a desired distance from said prestressed beams by a plurality of temporary support means such that a gap defining a cavity is created extending horizontally between said prestressed beams and said precast concrete slabs, enabling prestressing of said upwardly spaced precast concrete slabs independently of said prestressed beams in a direction that is substantially parallel to said prestressed beams, wherein adjacent pairs of said precast concrete slabs are connected by respective joints to form a continuous deck structure, said continuous deck structure being separated from said prestressed beams by a continuous concrete layer extending horizontally within an entire volume of said cavity between said prestressed beams and said continuous deck structure, forming a composite section comprising said prestressed beams, said continuous concrete slabs, said shear stirrup means and said concrete layer, such that said shear stirrup means transmit shear forces between said continuous deck structure and said prestressed beams via said continuous concrete layer.

15. A bridge structure according to claim 14 comprising several transversely connected composite bridge superstructures.

* * * * *